United States Patent [19]

Hageman

[11] Patent Number: 5,035,199

[45] Date of Patent: Jul. 30, 1991

[54] APPLICATOR FOR CREASE SETTING COMPOSITION

[75] Inventor: Paul Hageman, Ilkley, United Kingdom

[73] Assignee: Wool Development International Limited, Ilkley, United Kingdom

[21] Appl. No.: 363,092

[22] Filed: Jun. 8, 1989

[30] Foreign Application Priority Data

Jun. 9, 1988 [GB] United Kingdom ..... 8813673

[51] Int. Cl.[5] ..... B05C 5/00; B05C 13/02

[52] U.S. Cl. ..... 118/681; 68/200; 271/175; 414/789.5; 414/791.2; 118/45; 118/50; 118/411; 118/500

[58] Field of Search ..... 118/669, 676, 679–681, 118/687, 32, 44, 45, 50, 410, 411, 500; 414/789.5, 791.2; 271/175, 207; 493/400, 418, 450; 68/200, 201

[56] References Cited

U.S. PATENT DOCUMENTS

| | | | |
|---|---|---|---|
| 4,182,264 | 1/1980 | Gibson et al. | 118/306 |
| 4,477,218 | 10/1984 | Bean | 414/791.2 |
| 4,505,410 | 3/1985 | Coulter | 118/708 |
| 4,721,234 | 1/1988 | Spence | 118/410 |
| 4,756,170 | 7/1988 | Gibson et al. | 118/410 |
| 4,763,600 | 8/1988 | Saunders et al. | 118/684 |
| 4,778,299 | 10/1988 | Coulter | 118/710 |
| 4,816,015 | 3/1989 | Holder et al. | 493/400 |

FOREIGN PATENT DOCUMENTS

| | | | |
|---|---|---|---|
| 1580192 | 11/1980 | United Kingdom | 118/44 |

*Primary Examiner*—James C. Housel

[57] ABSTRACT

An applicator for a crease setting composition includes two or more applicator heads mounted over a surface having vacuum means for gripping a fabric. The applicator heads can be raised and lowered in unison and moved back and forth over the surface. When the rear edge of the fabric is sensed, the applicator heads drop onto the fabric and then are moved backwards while applying the crease setting composition to the fabric. When the front edge of the fabric is sensed, application of the setting composition is discontinued and the applicator heads are raised from the fabric. Channels or grooves in the surface, which supports the fabric during application of composition, receive the creases so that accurate alignment is maintained between the applicator heads and the creases. Air pressure is used for dispensing the composition.

8 Claims, 4 Drawing Sheets

APPLICATOR FOR CREASE SETTING COMPOSITION

BACKGROUND OF THE INVENTION

This invention relates to a fluid dispensing applicator for crease setting compositions.

Certain garments such as shirts, particularly for uniforms, are required to be provided with creases. In particular shirts for American uniforms carry three creases on the back panel. The production of these creases is a relatively complicated and time consuming operation especially where the creases are to be set using a crease retaining method. A crease retaining method known as the 'Lintrak' process is disclosed, inter alia, in GB-A-1603252 and EP-A-0067528.

An improved form of creasing press is disclosed in our co-pending U.S. Pat. application Ser. No. 299,951 for the production of two or more creases simultaneously which comprises a bed portion for receiving the fabric to be creased, the bed devised into three or more lands, each of the lands being movable with respect to the next adjacent land, and each land being provided with means for gripping the fabric. In this latter application two or more, and in particular three, creases in, for example a shirt back panel, can be formed simultaneously rather than in the complicated sequential manner employed at present.

The present invention seeks to provide an improved form of applicator which can apply crease setting composition into two or more creases simultaneously which may be used with the creasing press of our above application although is not restricted to use therewith.

According to the present invention there is provided an applicator for a crease setting composition which comprises two or more applicator heads mounted over respective means for gripping the fabric, means for raising the applicator heads and moving them forward, means for sensing the rear edge of the fabric and causing the applicator heads to drop on to the fabric, means for moving the applicator heads backwards thereby applying a crease setting composition to the fabric, and means for sensing the front edge of the fabric whereby to discontinue application of the crease setting agent.

The improved applicator of the invention is particularly useful with creased shirt panels which have been produced by the creasing press of our above mentioned co-pending application. Such panels will bear two or three pressed in creases and accordingly the applicator will preferably have two or three applicator heads together with respective means for gripping the fabric. The latter is preferably accomplished by the provision of a porous surface connected to a source of vacuum. Advantageously the surface will be provided with a channel, groove or the like in which the crease will lie so that it may be accurately alligned with the applicator head. The latter may be one of the forms of applicator head described in our above mentioned patent publications and will preferably be operated by air pressure (e.g. as disclosed in Japanese patent publication 61-34273).

Once the creasing heads have applied the crease setting composition within the creases the fabric panel is preferably automatically removed from the means for gripping the fabric, for example by means of a retractable grabbing arm, and dropped on to a stack of previously treated panels on a stacking platform. It is an especially advantageous feature of the invention that the stacking platform may be programmed to move incrementally from side to side so that each successive panel is displaced from the former panel by a small amount thereby ensuring that the apexes of the creases of the upper panel do not nest in the creases of the panel immediately below which could cause the crease setting composition to be transferred to the outer surface of the upper panel thereby disfiguring it. Other alternative ways of preventing unwanted transference of composition may be employed. For example, the panels could be hung vertically or placed on a conveyor which displaces by one pitch between each successive panel or the panels could be interleaved with release paper.

BRIEF DESCRIPTION OF THE DRAWINGS

The invention will be described further, by way of example, with reference to the accompanying drawings, in which.

DESCRIPTION OF THE PREFERRED EMBODIMENTS

Figure 1:
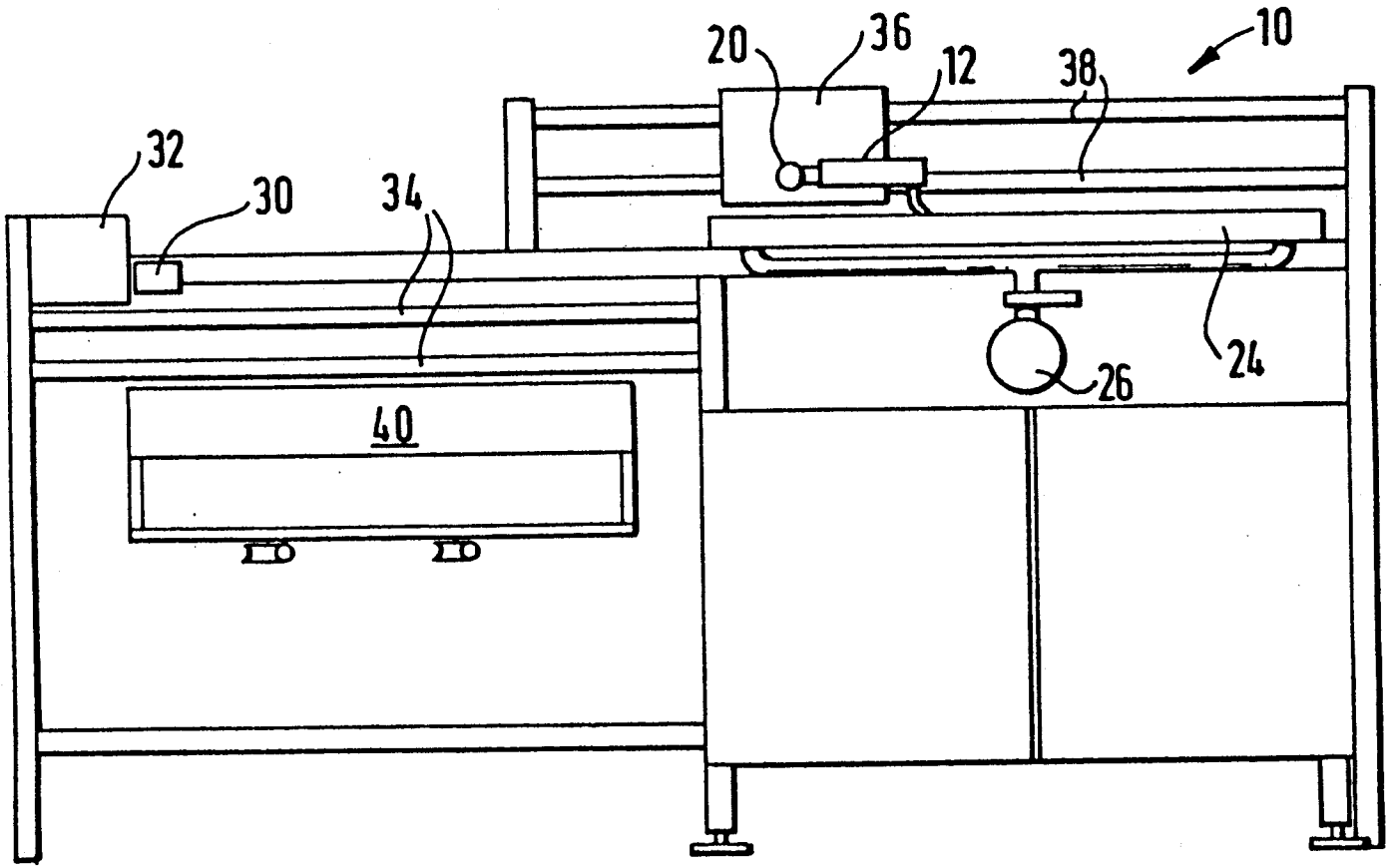
FIG. 1 is a diagrammatic general arrangement of an applicator in accordance with the invention.
Figure 2:
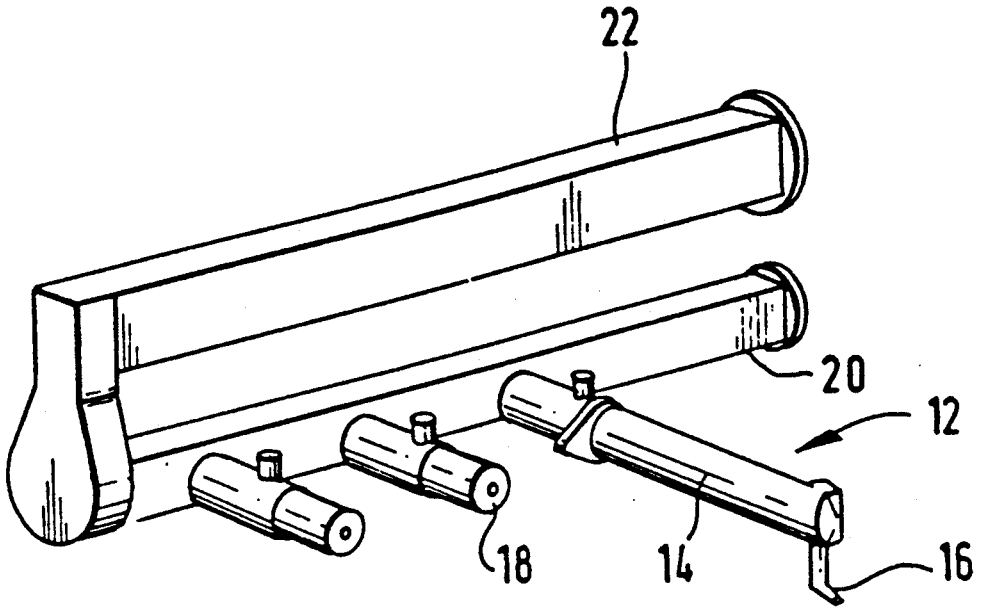
FIG. 2 is a detailed perspective view of the applicator heads.
Figure 3:
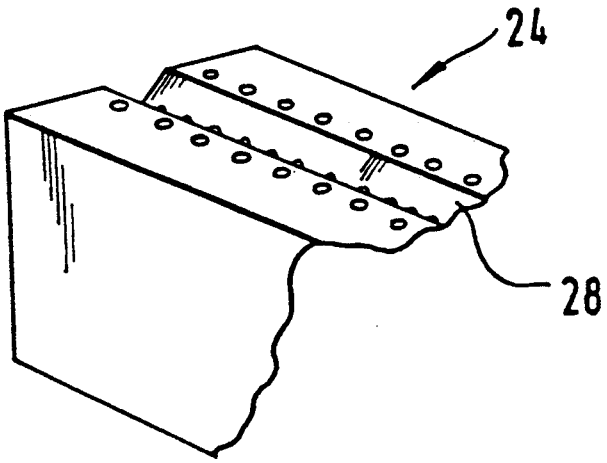
FIG. 3 is a partial detailed perspective view of fabric gripping means.
Figure 4:
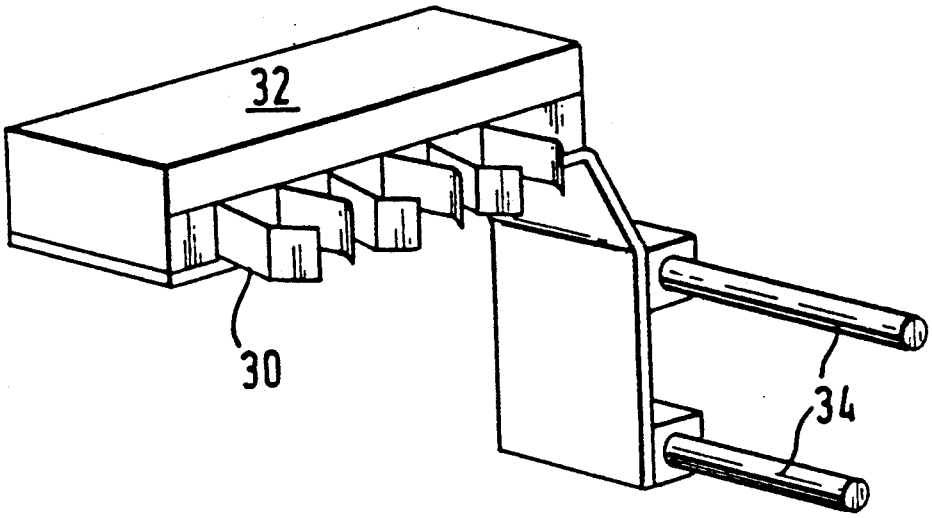
FIG. 4 is a partial detailed perspective view of fabric removing means.

Referring to the drawings, an applicator for crease setting composition generally designated 10 comprises a plurality of applicator heads 12, three being employed in the embodiment illustrated. Each of the heads 12 comprises a crease setting composition cartridge 14 having a nozzle 16 for applying the composition into the crease of a pre-creased fabric. The cartridges 14 are attached to means 18 for urging the composition within the cartridge out through the nozzle 16. Preferably air pressure is employed for this means in timed relationship with the movement of the applicator heads 12 as will be described more fully hereinafter. The heads 12 are mounted on an axle 20 which in turn is supported on a bracket 22 such that rotation of the axle 20 will cause the heads 12 to lift up away from the fabric being treated.

The fabric being treated (not shown), for example a shirt panel bearing three creases, is held in place by fabric gripping means 24 which comprises a porous surface connected to a source of vacuum 26. Beneath the nozzle 16 of each respective head 12 the gripping means 24 is provided with a groove or channel 28 to receive the apex of each crease of the pre-creased fabric.

Grippers 30, one pair for each head 12, are mounted on a gripper head 32 itself mounted for movement along the pair of parallel bars 34 towards and away from the creasing zone. The axle 20 carrying the heads 12 is also mounted on a body 36 in turn mounted for movement along a pair of parallel bars 38.

Figure 5:
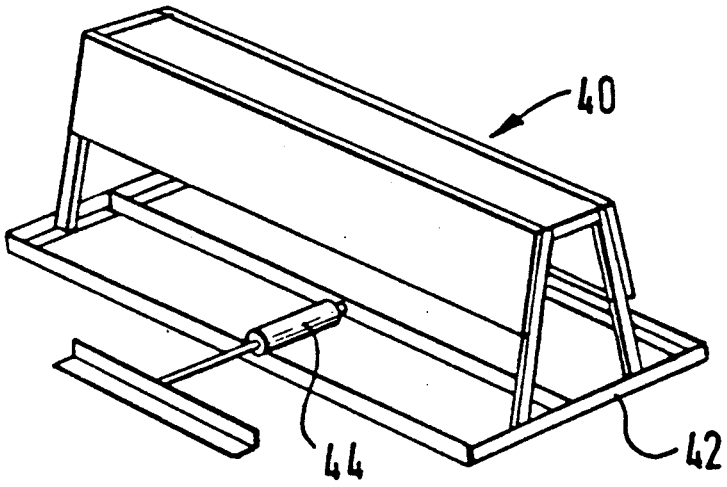
FIG. 5 is a perspective view of the fabric stacking platform.

Beneath the bars 34 is mounted a stacker platform 40 for receiving treated fabric panels. The upper portion of the platform 40 is shaped to allow the panels to drape over it. As can be seen from FIG. 5 the platform 40 is slideably mounted within a frame 42 and is provided with a cylinder 44 capable of moving it sideways (i.e. in and out with respect to the plane of the drawing of FIG. 1).

The operation of the device is as follows. A pre-creased fabric panel is laid by the operator on the fabric gripping means 24 with the apex of each crease located within the grooves 28. Vacuum is then applied through the porous surface thus gripping the panel firmly in position. The operatng cycle of the applicator is then actuated and the body 36 will move forward when the axle is rotated so that the nozzles 16 are well clear of the fabric surface. The body will move forward (that is to the right as viewed in FIG. 1) until a sensor (not shown) locates the trailing edge of the fabric at which point the body stops, the axle 22 rotated clockwise as viewed in FIG. 1 to bring the nozzles 16 in contact with the creases of the fabric, air pressure is applied to the cartridges 14 thereby expelling crease setting composition through the nozzles, and the body 36 is drawn backwards (that is to the left as viewed in FIG. 1) along the bars 38 thus laying an even line of crease setting composition in the creases in the fabric, all three creases being treated simultaneously. The first, or a second, sensor locates the leading edge of the fabric at which point air pressure is discontinued and the axle 22 rotated anti-clockwise bringing the creasing heads 12 out of contact with the fabric, the application of crease setting composition being finished. The gripper head 32 then moves along the bars 34 until the grippers 30 contact the fabric at which point they close and the head retracts to the position shown in FIG. 1. The grippers 30 open allowing the fabric to fall on the stacking platform 40. The cycle is now complete and the operator may put the next fabric panel in position.

Before the next cycle starts the platform 40 is moved to the side (that is in or out with respect to FIG. 1) by means of the cylinder 44 which is pre-programmed to move the platform 40 cyclically backwards and forwards. This ensures that each successive fabric panel is offset with respect to the panel immediately below it so that the creases do not 'nest' and cause crease settng composition to be passed from the valley of one crease to the apex of the next before it has had a chance to set. Every so often the stack of creased and treated panels is removed from the platform 40 for subsequent processing, e.g. making up into shirts.

Figure 6:
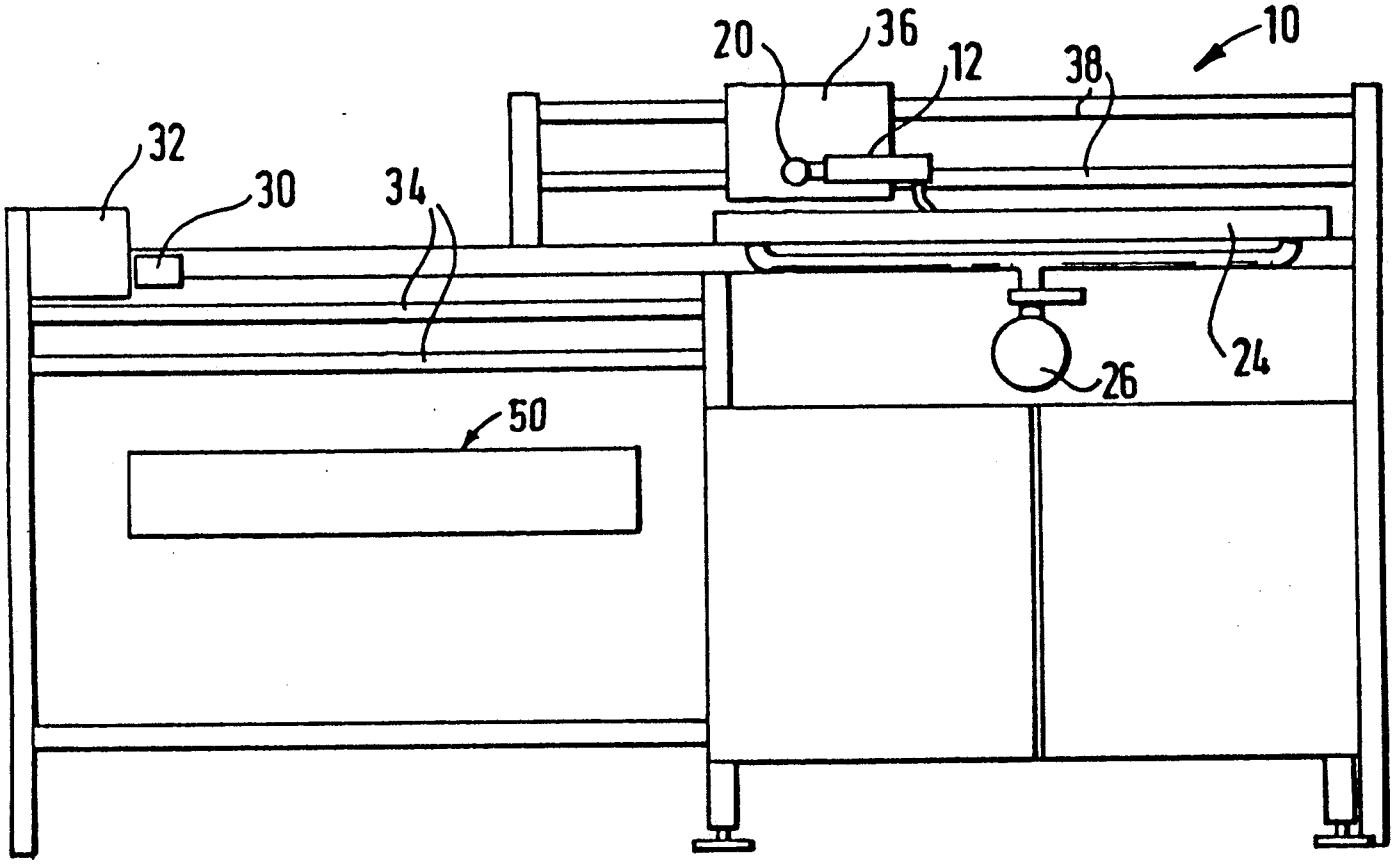
FIG. 6 is a view similar to FIG. 1 showing an alternative embodiment of the invention.

As shown in FIG. 6, the applicator may alternatively include a conveyor (50), which displaces incrementally between the successive panels so that one crease does not directly nest with another crease.

Speed of movement of the applicator heads is controlled to give reproducible and even deposition of crease setting composition.

The apparatus of the invention provides a simple means of applying crease setting composition to two or more creases simultaneously. Advantages include improved quality of product, elimination of human error through controlled speed of application and reduced fatigue of operator.

I claim:

1. An applicator for applying a crease setting composition to a plurality of parallel creases on a fabric panel having a first edge and a second edge, comprising:

stationary means for gripping said fabric panel and holding it stationary while crease setting composition is applied;

at least two applicator heads mounted over said means for gripping said fabric panel, said heads being subjected to acuation for dispensing said composition;

moving means for raising and lowering said applicator heads and for translating said heads forward and backwards along said gripping means;

means for sensing said first edge, said moving means lowering said head to said fabric panel in response to detection of said first edge, and translating said heads from said first edge to said second edge;

means for actuating said heads to dispense said composition during said translation between said first and said second edges;

means for sensing said second edge and discontinuing said dispensing when said second edge is detected.

2. An applicator as in claim 1, wherein the number of said applicator heads is three, respective means for gripping said fabric panel being associated with each said head.

3. An applicator as in claim 2, wherein said means for gripping said fabric panel includes a porous surface subject to connection to a source of vacuum.

4. An applicator as in claim 3, wherein said surface includes a respective depression wherein a crease may lie, accurately aligned with the translation direction of the associated applicator head.

5. An applicator as in claim 4, wherein said applicator heads include means for dispensing said composition, said means for dispensing being subject to operation by application of air pressure.

6. An applicator as in claim 1, and further comprising a stacking platform and a retractable grabbing arm, said arm being adapted to automatically remove said fabric panel after the composition is dispensed within the creases, said retractable grabbing arm being further adapted to drop said grabbed fabric panel onto a stack of previously treated fabric panels on said stacking platform.

7. An applicator as in claim 6, wherein said stacking platform is movable from side to side in the directions transverse to the translation of said heads, and further comprising means for moving said stacking platform from side to side.

8. An applicator as in claim 1, and further comprising a conveyor and a retractable grabbing arm for automatically removing said fabric panel from said means for gripping after the composition is dispensed, said grabbing arm placing said panel on said conveyor, said conveyor moving incrementally between receipt of each successive panel.

* * * * *